US005097965A

United States Patent [19]

Fehr

[11] Patent Number: 5,097,965

[45] Date of Patent: Mar. 24, 1992

[54] PAINT BRUSH SUSPENSION DEVICE

[76] Inventor: Richard Fehr, P.O. Box 5109, Berkeley, Calif. 94705

[21] Appl. No.: 656,976

[22] Filed: Feb. 19, 1991

[51] Int. Cl.[5] ..... A47F 7/00

[52] U.S. Cl. ..... 211/65; 248/110

[58] Field of Search ..... 211/65, 66, 113; 248/110, 113, 213.2

[56] References Cited

U.S. PATENT DOCUMENTS

| | | | |
|---|---|---|---|
| 2,057,225 | 10/1936 | Bernick | 248/110 X |
| 2,224,467 | 12/1940 | Bauerle | 248/113 |
| 2,278,650 | 4/1942 | Drinkwater | 211/65 |
| 2,389,756 | 11/1945 | Beech | 248/110 |
| 2,460,136 | 1/1949 | Leonard et al. | 248/113 X |
| 2,468,631 | 4/1949 | Jauss | 248/110 |
| 2,605,986 | 8/1952 | Schulz | 248/113 |
| 2,675,979 | 4/1954 | Vetterli et al. | 248/113 |
| 2,703,652 | 10/1955 | Dominik | 211/65 |
| 2,724,570 | 11/1955 | Richardson | 248/113 |
| 2,852,144 | 9/1958 | Reno | 248/110 |
| 2,907,540 | 10/1959 | Wheeler | 248/113 |
| 2,943,761 | 7/1960 | Marier | 248/110 |
| 3,185,311 | 5/1965 | Roberts et al. | 248/213.2 X |
| 3,905,476 | 9/1975 | Foreman | 206/361 |
| 4,211,158 | 7/1980 | Rice, Jr. | 248/113 X |
| 4,627,125 | 12/1986 | Gruns | 15/105 |
| 4,909,467 | 3/1990 | Shan-Pao | 248/113 X |

FOREIGN PATENT DOCUMENTS

| | | | |
|---|---|---|---|
| 0356393 | 7/1922 | Fed. Rep. of Germany | 211/65 |
| 0690512 | 4/1940 | Fed. Rep. of Germany | 211/65 |

*Primary Examiner*—Carl D. Friedman
*Assistant Examiner*—Sarah A. Lechok
*Attorney, Agent, or Firm*—Harris Zimmerman

[57] ABSTRACT

A device for suspending one or more paint brushes within a container out of contact with the bottom of the container has a pair of slats disposed in side by side relationship and which are of sufficient length to span the container rim. A pair of spaced apart elastic bands encircle the intermediate regions of the slats and urge the slats together enabling paint brush handles to be gripped between facing surfaces of the intermediate regions. End portions of the slats diverge from each other at each end of the device. This enables spreading of the slats at one end of the device, to admit a brush handle, by manually squeezing the end portions at the other end of the device.

14 Claims, 2 Drawing Sheets

PAINT BRUSH SUSPENSION DEVICE

TECHNICAL FIELD

This invention relates to painting equipment and more particularly to devices for suspending paint brushes within a receptacle out of contact with the bottom of the receptacle during cleaning of the brushes or during temporary interruptions in the course of painting operations.

BACKGROUND OF THE INVENTION

Paint brushes are most easily cleaned by soaking the brush within a container of paint thinner or other solvent. Resting the bottom of the brush against the bottom of the container for a prolonged period can cause a damaging permanent deformation of the bristle region of the brush. This can avoided by suspending the brush within the container in a manner which keeps the bristles out of contact with the container base.

Suspension of a brush within a container is also advantageous during operations other than cleaning. For example, a wet paint brush frequently poses problems when a painting operation must be temporarily interrupted. The brush cannot be simply rested on a nearby surface without transfering paint to the surface and this also risks contamination of the brush with particulate matter. Hanging the brush from a hook, nail or the like may drip paint on the underlying floor. Resting the brush within a container is subject to the bristle deformation problem discussed above. This may also coat the upper regions of the brush with paint if the container is the paint can itself.

A variety of devices have heretofore been developed for the purpose of suspending one or more paint brushes at an elevated location within a container. These are in general undesirably complex and costly and can pose problems of their own during use. Such prior devices typically have clips, clamps or other mechanisms for gripping the brush handle that are difficult to operate while one is also holding the wet brush in one hand. In other instances, the brush and/or the container itself must have a specialized construction in order to accommodate to the suspension means.

The present invention is directed to overcoming one or more of the problems discussed above.

SUMMARY OF THE INVENTION

In one aspect of the present invention, a device for suspending at least one paint brush within a container includes a pair of slats each having a length sufficient to span the rim of the container. The slats are disposed in side by side relationship and have intermediate regions which grip the paint brush. The end regions of the two slats diverge from each other at least at one end of the device. At least one resilient member extends between the intermediate regions of the slats and urges the slats together to exert a clamping force on the paint brush.

In another aspect of the invention, a device for suspending paint brushes within a container includes a pair of slats of sufficient length to span the container and to overlap the container rim. The slats are in side by side relationship and have intermediate regions with facing side surfaces for gripping the paint brushes between such surfaces. The end regions of the slats diverge from each other at each end of the device. A pair of continuous elastic bands encircle the intermediate regions of the slats and are proportioned to urge the slats together.

The bands are spaced apart from each other and are also spaced apart from the divergent end regions of the slats.

The invention provides a very simple and economical means for suspending one or more paint brushes within a liquid container for cleaning purposes or for avoiding an unwanted transfer of paint to other objects when painting operations are temporarily interrupted. The brush is held out of contact with the bottom of the container thereby avoiding deformation of the bristle region of the brush. The configuration of the suspension device enables an extremely simple mode of engaging and disengaging brushes. In particular, squeezing of one end of the device by the painters free hand spreads the brush handle gripping components at the other end of the device enabling insertion of the brush with a minimum of difficulty.

The invention, together with further aspects and advantages thereof, may be further understood by reference to the following description of the preferred embodiment and by reference to the accompanying drawings.

DETAILED DESCRIPTION OF THE PREFERRED EMBODIMENT

Figure 1:
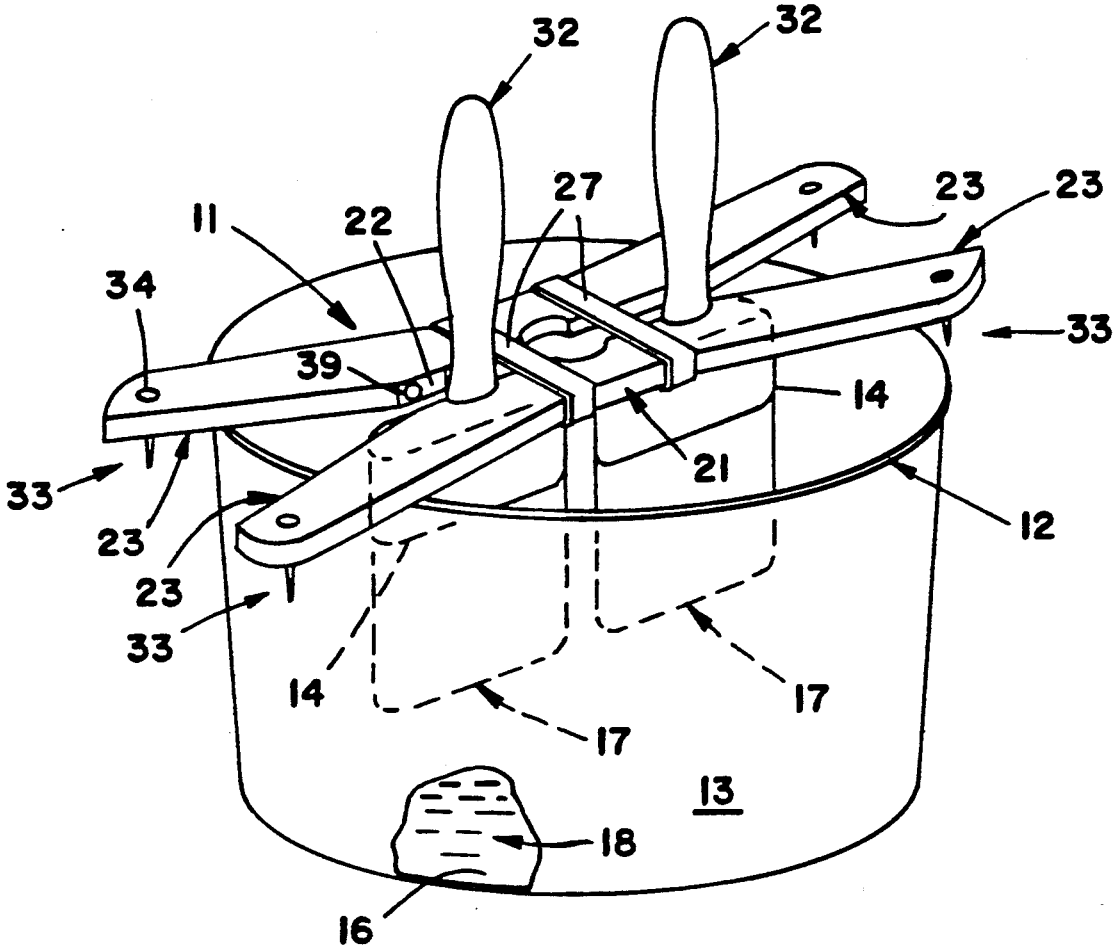
FIG. 1 is a broken out perspective view depicting a paint brush suspension device in accordance with the preferred embodiment of the invention as it appears when it is suspending a pair of brushes within a container.

Referring initially to FIG. 1 of the drawings, a paint brush suspension device 11 in accordance with this embodiment of the invention is adapted to span the rim 12 of an open container 13 and to support one or more paint brushes 14 within the container. The suspension device 11 holds the brushes 14 in an upright orientation with the brushes being spaced above the bottom or floor 16 of the container to avoid deformation of the bristle regions 17 of the brushes. The suspension device 11 enables the vertical position of the brushes 14 within the container 13 to be varied in instances where just the lower regions of the brushes are to be immersed in a liquid 18 within the container.

The container 13 itself may be of any various types such as a paint can, a disposable paper or plastic receptacle or a glass jar, for example.

Figure 2:
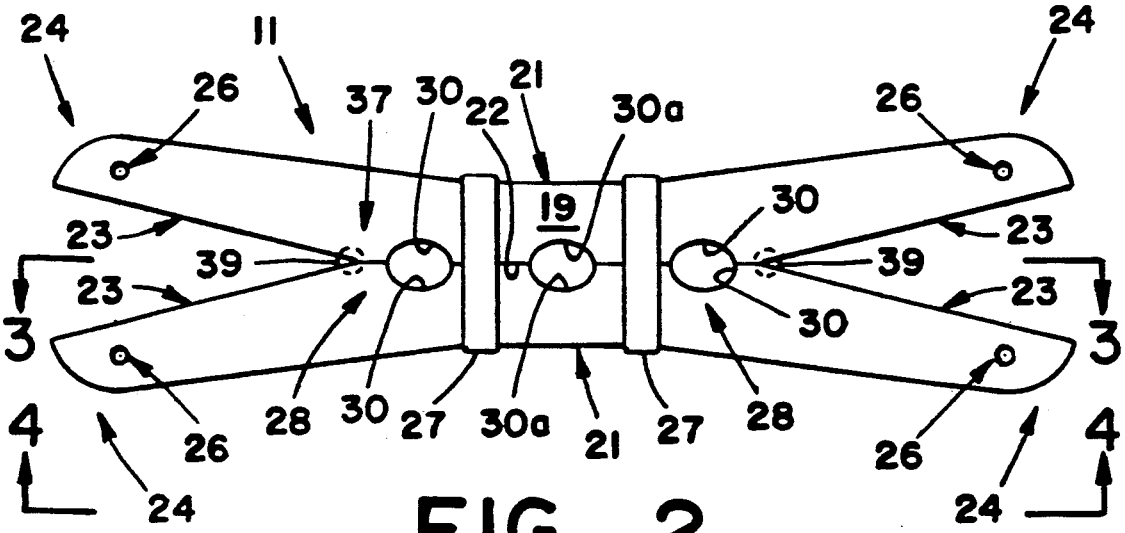
FIG. 2 is a plan view of the device of FIG. 1 as it appears in the absence of a paint brush.
Figure 3:
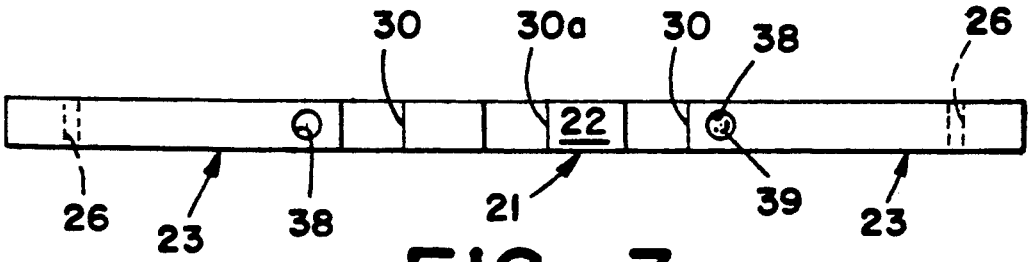
FIG. 3 is a side view of a slat component of the device of the preceding figures taken along line 3—3 of FIG. 2.
Figure 4:
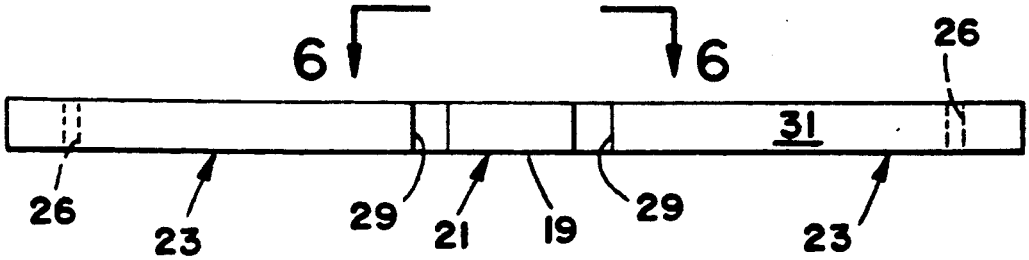
FIG. 4 is a view of the opposite side of the slat component taken along line 4—4 of FIG. 2 except that elastic bands shown in the preceding figures are omitted in order to show a feature of the slat component that would otherwise be concealed by such bands.

Referring to FIGS. 2, 3 and 4 in conjunction, components of the brush suspension device 11 include a pair of elongated slats 19 which are disposed in side by side relationship. The intermediate regions 21 of the slats 19 have facing side surfaces 22 that abut against each other in the absence of a paint brush and which can be spread apart in order to grip paint brushes during use of the device. The end regions 23 of the slats 19 are angled relative to the intermediate regions 21 and become progressively further apart towards each end of the device 11. The divergent end regions 23 enable the paint brush gripping surfaces 22 to be temporarily spread apart by a one handed compression of one end of the device as will hereinafter be further described.

The extremities 24 of the end regions 23 preferably have a curved configuration, rather than an angular one, to facilitate the gripping and compression of the end regions. For purposes which will hereinafter be described, each such extremity 24 is transpierced by a small passage 26 which extends vertically when the device 11 is in use on the rim of a container.

The two slats 19 may have identical configurations in order to simplify the manufacturing process although this is not essential in all cases and may be formed of any of various materials. In the present example, the slats 19 are formed from flat panels of wood.

Figure 5:
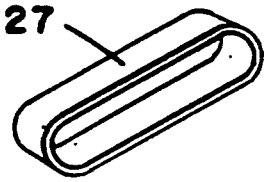
FIG. 5 is a perspective view of one of the elastic band components of the brush suspension device.

Referring jointly to FIGS. 2 and 5, the slats 19 are held together and continually urged towards each other by resilient members 27 which are preferably a pair of tensioned continuous elastic bands of rubber or the like that encircle the intermediate regions 21 of both slats. The two bands 27 are spaced apart from each other in order to hold the slats 19 in coplanar relationship and are preferably equidistant from the midpoints of the slats so that resistance to spreading of the end regions 23 of the slats is the same at both ends of the device 11. The two bands 27 are also spaced away from the angled end regions 23 of the slats 19. This leaves an unobstructed area 28 at each end of the brush gripping surfaces 22 into which the handle of a paint brush may be received. Slats 19 preferably have shallow notches 30 at such areas 28 in order to inhibit longitudinal movement of the gripped paint brushes although this is not essential in all cases as there is substantial frictional resistance to such motion. Similar notches **30*a* may be provided in the slats 19 at a location midway between the elastic bands 27** to provide for gripping of a single brush for better balance when only one brush is being used.

Figure 6:
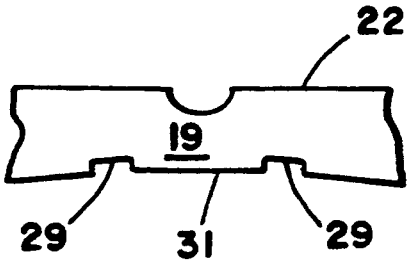
FIG. 6 is a plan view of a portion of the device taken along line 6—6 of FIG. 4.

Referring to FIGS. 4 and 6 in conjunction, the elastic bands are held at the above described positions along the slats 19 by being seated in a pair of spaced apart notches 29 which extend into the surfaces 31 of the slats that are opposite from the brush gripping surfaces 22.

In operation, with reference again to FIG. 1, the handles 32 of the paint brushes 14 are positioned between the brush gripping surfaces 22 of the slats 19 and are clamped in place by the forces exerted by the tensioned elastic bands 27. The device 11 is then rested on the container rim 12 with the brushes being inside the container 13 and with the end regions 23 of slats 19 overlapping the container rim. The device 11 may grip a brush 14 at any selected location along the brush handle 32 in order to position the lower end 17 of the brush at a desired elevation above the bottom 16 of container 13.

The device 11 may be used to suspend a plurality of brushes 14 at the same time. This is advantageous in that persons who are painting structural walls or the like often use two or more brushes of different sizes. As is apparent, the device 11 may also be used to suspend a single brush 14.

Downwardly directed linear retainer elements 33, having enlargements 34 at the upper ends, may be placed in the previously described passages 26 near the extremities 24 of slats 19 to assure that opposite ends of the slats remain in an overlapping relationship with container rim 12 at opposite sides of the container 13. As a practical matter, the retainer elements 33 may be ordinary nails, screws or other similar elements provided that the head enlargements of such elements have a diameter greater than the diameter of the passages 26.

Figure 7:
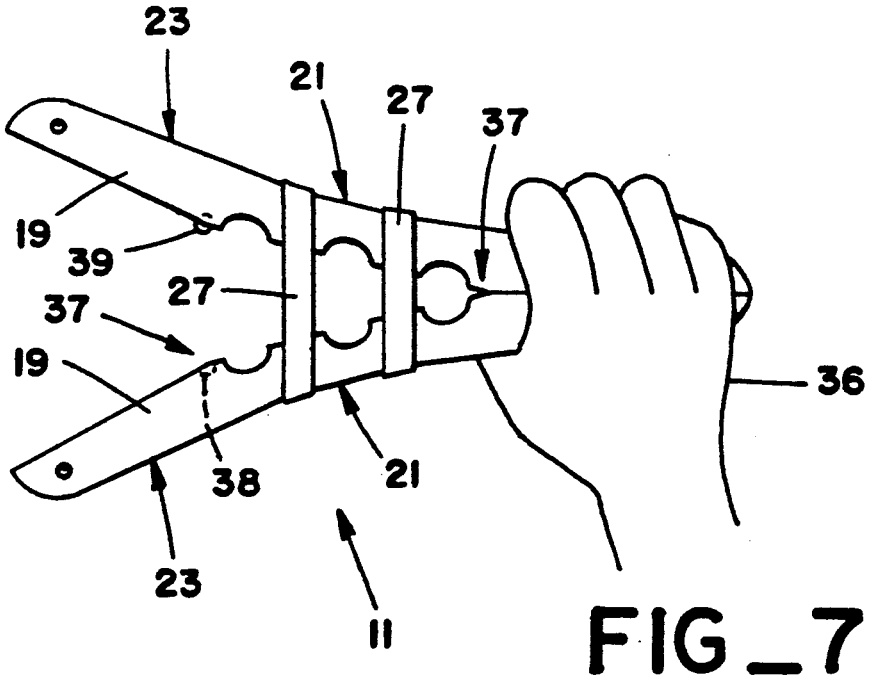
FIG. 7 is a view depicting opening of the brush suspension device in preparation for receiving a brush.

Referring to FIG. 7, spreading of the end portions 23 at one end of the device 11 to enable insertion or removal of a brush is easily accomplished with one hand 36 while the other hand (not shown) remains free to grasp and manipulate the brush. Such spreading occurs in response to squeezing of the other end of the device 11. The angled junctions 37 between the intermediate regions 21 and end regions 23 of slats 19 act as fulcrum points about which the remote end regions 23 of slats 19 are pried apart against the resistance of elastic bands 27. Release of the hand pressure on the device causes the elastic bands 27 to return the spread end regions 23 towards each other and to exert clamping pressure on the brush handle. Insertion of a second brush is accomplished in a similar manner by squeezing the other end of the device 11.

Although it is not essential in all cases, each slat 19 preferably has a hemispherical cavity 38 at each fulcrum point 37. The cavities seat a ball detent 39 at each end of the intermediate regions 21 of the slats, the detents preferably being secured to one of the slats 19 by adhesive or other means. The detents 39 assure that the two slats 19 remain in longitudinal register with each other and also act as bearings during the above described spreading of the slats.

Referring again to FIG. 1, the device 11 is shown with proportions suitable for suspending large brushes 14 of the type commonly used for painting the interior or exterior of houses or other buildings. The device 11 may be made in other sizes for use with different sized brushes. A substantially smaller sized device 11, for example, may be used to suspend an artist's brushes in relatively small containers such as drinking glasses, paper cups or the like.

The herein described preferred embodiment of the invention has divergent end regions 23 at each end of the device 11 to enable either end to be opened in the above described manner for the purpose of receiving a brush handle. The device 11 can be constructed with divergent end regions 23 at one end only although only one end can then be opened in the above described manner.

While the invention has been disclosed with reference to a single embodiment for purposes of example, many variations and modifications of the device are possible and it is not intended to limit the invention except as defined in the following claims.

I claim:

1. A device for suspending at least one paint brush within a container which has a rim defining an opening at the upper end of the container wherein said device comprises:

a pair of rigid slats each having a length sufficient to span said rim of said container, said slats being disposed in side by side relationship and having intermediate regions situated away from the ends of said slats between which said paint brush may be gripped and further having end regions which extend from said intermediate regions at each end thereof for a distance sufficient to enable said slats to span said container rim while suspending said paint brush in said container, said end regions of said slats being divergent at least at one end thereof, and at least one elastic member extending between said intermediate regions of said slats and being biased to urge said slats towards each other, said elastic member being at an intermediate location along said slats that is spaced apart from said divergent end regions of said slats.

2. The device of claim 1 wherein said end regions of said slats are divergent at both ends of said device.

3. The device of claim 2 wherein said elastic member is a continuous elastic band encircling said intermediate regions of each of said slats at a location thereon which is spaced apart from said end regions of said slats.

4. The device of claim 2 having a spaced apart pair of said elastic members, said elastic members being elastic bands which encircle said intermediate regions of said slats at locations which are spaced apart from said divergent end regions of said slats.

5. The device of claim 4 wherein said elastic bands are substantially equidistant from the midpoints of said slats.

6. The device of claim 4 wherein said intermediate regions of said slats have first side surfaces which abut against each other in the absence of said paint brush and have opposite side surfaces, said opposite side surfaces having a pair of spaced apart notches therein in which said pair of elastic bands are seated, said notches being at said locations which are spaced apart from said divergent end regions of said slats.

7. The device of claim 4 wherein said intermediate regions of said slats have first side surfaces which face each other and which abut each other in the absence of said paint brush, said slats each having a plurality of notches in said first side surface thereof, the notches being at corresponding locations along the two slats to form facing pairs of notches along said device, each facing pair of notches being proportioned to jointly receive the handle of a paint brush and wherein a first of said pairs of notches is located between one of said elastic bands and the closest of said end regions of said slats and a second of said pairs of notches is located between the other of said elastic bands and the other end regions of said slats.

8. The device of claim 7 wherein a third of said pairs of notches is located between said elastic bands.

9. The device of claim 1 wherein said intermediate regions of said slats have first side surfaces which face each other, a first of said slats having a cavity in said first side surface thereof at the junction of said intermediate region with said divergent end region, the other of said slats having a rounded detent protuberance which seats in said cavity.

10. The device of claim 1 wherein at least one of said slats is transpierced by a retainer receiving passage at each end of said device, the passages at the opposite end regions of said device being spaced apart by a distance at least equal to the diameter of the rim of said container.

11. The device of claim 10 further including a plurality of linear retainer elements each extending through a separate one of said passages and extending downward from said slats, said linear retainer elements having upper ends which are enlargements having a diameter that is greater than the diameter of said passages.

12. A device for suspending paint brushes within a container of the type having a rim at the upper end that defines a container opening, said device being comprised of:

a pair of elongated rigid slats of sufficient length to span said container and to overlap said rim thereof, said slats being in side by side relationship and having intermediate regions situated away from both ends of said slats and which have facing side surfaces for gripping said paint brushes therebetween, said slats having end regions which diverge from each other at each end of said device and which extend away from said intermediate regions a distance sufficient to enable said slats to span said container rim while suspending a paint brush in said container, and a pair of continuous elastic bands encircling said intermediate regions of said slats and being proportioned to clasp said slats together, said bands being spaced apart from each other and being spaced apart from said divergent end regions of said slats.

13. The device of claim 12 wherein each of said slats has an opposite side surface at the side of the slat that is opposite from said facing surface thereof and has a pair of spaced apart notches in said opposite side surface, said notches being at locations which are spaced apart from said divergent end regions of said slats and wherein said elastic bands are seated in said notches.

14. A device for suspending paint brushes within a container of the type having a rim at the upper end that defines a container opening, said device being comprised of:

a pair of elongated slats of sufficient length to span said container and to overlap said rim thereof, said slats being in side by side relationship and having intermediate regions with facing side surfaces for gripping said paint brushes therebetween, said slats having end regions which diverge from each other at each end of said device, and wherein one of said slats has a first rounded cavity adjacent one end of said intermediate region thereof and the other of said slats has a first rounded detent protuberance which seats in said first cavity, and wherein one of said slats has a second rounded cavity at the opposite end of said intermediate region thereof and the other of said slats has a second rounded detent protuberance which seats in said second cavity, and a pair of continuous elastic bands encircling said intermediate regions of said slats and being proportioned to clasp said slats together, said bands being spaced apart from each other and being spaced apart from said divergent end regions of said slats.

* * * * *